US005441854A

United States Patent [19]

Texter et al.

[11] Patent Number: 5,441,854

[45] Date of Patent: * Aug. 15, 1995

[54] PHOTOGRAPHIC IMAGE FORMING PROCESS UTILIZING A BARRIER LAYER FOR DIFFUSIBLE DYE CONTAINMENT

[75] Inventors: John Texter, Rochester; Wayne A. Bowman, Walworth; Glenn T. Pearce, Fairport, all of N.Y.

[73] Assignee: Eastman Kodak Company, Rochester, N.Y.

[ * ] Notice: The portion of the term of this patent subsequent to Feb. 22, 2011 has been disclaimed.

[21] Appl. No.: 276,294

[22] Filed: Jul. 18, 1994

Related U.S. Application Data

[63] Continuation of Ser. No. 952,447, Sep. 28, 1992, Pat. No. 5,370,967.

[51] Int. Cl.[6] ..... G03C 8/10; G03C 8/20; G03C 8/32; G03C 8/56

[52] U.S. Cl. ..... 430/376; 430/214; 430/215; 430/226; 430/375; 430/377; 430/390; 430/523; 430/536; 430/537; 430/543

[58] Field of Search ..... 430/214, 215, 226, 375, 430/376, 377, 390, 523, 536, 537, 543

[56] References Cited

U.S. PATENT DOCUMENTS

| | | | |
|---|---|---|---|
| 3,227,550 | 1/1966 | Whitmore et al. | 96/3 |
| 3,477,849 | 11/1969 | Becker | 96/29 |
| 3,498,785 | 3/1970 | Bloom et al. | 96/3 |
| 3,734,726 | 5/1973 | Figueras et al. | 96/3 |
| 3,743,504 | 7/1973 | Dappen et al. | 96/3 |
| 3,751,406 | 8/1973 | Bloom | 260/162 |
| 3,885,969 | 5/1975 | Kruck | 96/84 R |
| 3,888,669 | 6/1975 | Cardone | 96/3 |
| 3,928,312 | 12/1975 | Fleckenstein | 260/156 |
| 4,055,429 | 10/1977 | Holmes et al. | 96/74 |
| 4,056,394 | 11/1977 | Hannie | 96/290 |
| 4,076,529 | 2/1978 | Fleckenstein et al. | 96/3 |
| 4,088,499 | 5/1978 | Brust et al. | 96/290 |
| 4,353,972 | 10/1982 | Helling et al. | 430/213 |
| 4,379,838 | 4/1983 | Helling et al. | 430/518 |
| 4,388,402 | 6/1983 | Mukunoki et al. | 430/527 |
| 4,420,556 | 12/1983 | Booms et al. | 430/549 |
| 4,504,569 | 3/1985 | Abel et al. | 430/214 |
| 4,567,135 | 1/1986 | Arakawa et al. | 430/505 |
| 4,840,885 | 6/1989 | Peters et al. | 430/559 |
| 4,865,946 | 9/1989 | Bowman et al. | 430/215 |
| 4,920,032 | 4/1990 | Toya et al. | 430/536 |
| 5,322,758 | 6/1994 | Texter et al. | 430/213 |
| 5,342,730 | 8/1994 | Welter et al. | 430/213 |

FOREIGN PATENT DOCUMENTS

| | | |
|---|---|---|
| 2032336 | 2/1990 | Japan . |
| 3001134 | 1/1991 | Japan . |
| 1451420 | 10/1976 | United Kingdom . |
| 2062270 | 9/1981 | United Kingdom . |
| WO91/15526 | 10/1991 | WIPO . |

OTHER PUBLICATIONS

Research Disclosure 19551, Jul. 1980, pp. 301–310, anonymous.

*Primary Examiner*—Charles L. Bowers, Jr.
*Assistant Examiner*—J. Pasterczyk
*Attorney, Agent, or Firm*—Paul A. Leipold

[57] ABSTRACT

A process is disclosed for forming a color photographic image comprising the steps of:

(a) providing an integral element comprising one and only one dimensionally stable layer comprising a reflection base or transparent base coating support, and coated thereon in reactive association an imaging layer comprising radiation sensitive silver halide, a diffusible dye forming layer comprising a diffusible dye forming compound, and a barrier layer overlaying said diffusible dye forming layer;

(b) exposing this integral element to actinic radiation (c) processing this integral element by contacting this element to an external bath containing compounds selected from the group consisting of color developer compounds, compounds which activate the release of incorporated color developers, and compounds which activate development by incorporated dye developers; and (d) washing this integral element to remove compounds imbibed in step (c). The diffusible dye forming layer is the same or different than the imaging layer. The barrier layer comprises a polymer that allows the passage of solutions for processing this integral element when this element is contacted with an external processing bath. This barrier layer impedes the diffusion of the diffusible dye formed from the diffusible-dye forming compound out of this integral element.

20 Claims, 2 Drawing Sheets

PHOTOGRAPHIC IMAGE FORMING PROCESS UTILIZING A BARRIER LAYER FOR DIFFUSIBLE DYE CONTAINMENT

This is a Continuation of application Ser. No. 952,447, filed Sep. 28, 1992, now U.S. Pat. No. 5,370,962.

RELATED APPLICATIONS

This application is related to copending, commonly assigned, simultaneously filed U.S. Application Ser. Nos. 07/952,447 of Texter et al., *Polymeric Barrier Layer for Diffusible-Dye Containment in Photographic Elements* filed Sep. 28, 1992, now U.S. Pat. No. 5,370,967, Ser. No. 07/952,556 of Texter et al., *Integral Color Diffusion Transfer Element for Large Volume Development* filed Sep. 28, 1992, now U.S. Pat. No. 5,322,758, and Ser. No. 07/952,444 of Welter and Texter, *Dye Releasing Couplers for Color Diffusion Transfer Element* filed Sep. 28, 1992, now U.S. Pat. No. 5,342,730 and toe copending, commonly assigned U.S. application Ser. Nos. 08/125,990 of Texter, *Solid Particle Coupler Dispersions for Color Diffusion Transfer Elements* filed Sep. 23, 1993, 07/742,784 of Roberts et al., *Thermoreversible Heat-Thickening Polyacrylamides* filed Aug. 10, 1991, and 07/771,030 of Pearce et al., *Development Inhibitor Reflector Layers* filed Aug. 15, 1991, now U.S. Pat. No. 5,254,441.

1. Technical Field

This invention relates to photographic imaging systems that utilize silver halide based radiation sensitive layers and associated formation of image dyes in a wet development process and to systems which utilize polymeric barrier layers to control diffusion of particular components. In particular, this invention relates to such systems where the resulting dyes, when the photographic elements are substantially wet, have substantial solubility and freedom to diffuse and smear. More particularly, this invention relates to systems that utilize large volume development processing baths.

2. Background Art

Diffusible Dye Forming Compounds

The use of diffusible dyes in photographic image transfer systems is well known, as is the formation of diffusible dyes from nondiffusing dye forming compounds. Whitmore and Mader, in British Patent Specification Nos. 840,731 and 904,364 and in U.S. Pat. No. 3,227,550, discuss the use of such compounds in certain image transfer photographic systems. Their inventions utilized preferred diffusible dye forming compounds which may be described as couplers of the general structure R-Cp-R' where Cp is a coupler residue forming a dye with a p-phenylenediamine or other developing agent, R is a removable substituent in the coupling position such as a ballast group rendering the coupler nondiffusing or a removable preformed dye molecule, and R' is a ballast group or a solubilizing group in a noncoupling position of the coupler residue. Either R or R' or both may contain solubilizing groups rendering the dye formed or split off during or after development diffusible in the photographic element wetted with processing solutions such as alkaline development solutions.

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Sakanoue, Hirano, Adachi, Minami, and Kanagawa in German Offen. No. 3,324,533 A1, Booms and Holstead in U.S. Pat. No. 4,420,556, and Arakawa and Watanabe in European Patent Specification 115,303 B 1 disclose the use of diffusible dye forming couplers to provide photographic materials with improved graininess.

Figueras and Stern disclose in U.S. Pat. No. 3,734,726 the use of substantially colorless m-sulfonamidoaniline and m-sulfonamidophenol compounds that react with oxidized color development agents to release a coupler moiety that couples with oxidized color developing agent to produce diffusible dye in color diffusion transfer elements and processes. Fleckenstein discloses in U.S. Pat. No. 3,928,312 and Fleckenstein and Figueras disclose in German Offen. No. 2,242,762, in U.S. Pat. No. 4,076,529 the use of p-sulfonamidoaniline, p-sulfonamidophenol, p-sulfonamidonaphthol, and related compounds which react with oxidized color development agents to release diffusible dyes in color diffusion transfer elements and processes.

Bloom and Stephens in U.S. Patent Nos. 3,443,939 and 3,498,785, Bloom and Rogers in U.S. Pat. No. 3,443,940, and Bloom in U.S. Pat. No. 3,751,406 disclose the use of m-amidophenols, m-amidoanilines, and related compounds that release dyes or dye precursors upon reaction with oxidized color developer in color diffusion transfer units and processes.

Barrier Layers

Becker, in U.S. Pat. Nos. 3,384,483 and 3,477,849, discloses the use of a barrier layer comprising an alkali-permeable, water-insoluble polyvalent metal salt of a film-forming alkali-permeable, water-soluble polymeric carboxylic acid useful in preparing multicolor dye developer diffusion transfer images. The barrier layer functions to reduce color contamination of the transferred images by impeding the diffusion of the dye developer.

Kruck, in U.S. Pat. No. 3,885,969, discloses the use of a lyophobic barrier layer consisting of a salt of an acetate of polyvinylalcohol or of a hydroxyl-containing copolymer and an aldehyde sulfonic acid, between plasticized support layers and an antihalation layer, in dye image providing materials.

Cardone, in U.S. Pat. No. 3,888,669, discloses the use of barrier layers in multilayer and multicolor composite diffusion transfer film units. Said diffusion transfer film units comprise diffusible dye forming layers, a dye fixing layer or a dye mordanting layer, an opaque layer or means for producing an opacifying layer, a barrier layer impermeable to the diffusible dyes produced but permeable to a contacting processing composition, a dimensionally stable transparent layer adjacent to the barrier layer, means for interposing between said barrier layer and said adjacent dimensionally stable transparent layer a processing composition, and means for maintaining the composite film unit intact subsequent to diffusion transfer processing of the unit.

The use of spacer layers or timing layers as barrier layers to delay the function of neutralizing layers in diffusion transfer processes is described in U.S. Pat. Nos. 2,584,030, 3,419,389, 3,421,893, 3,433,633, 3,455,686, 3,592,645, 3,756,815, and 3,765,893, and in *Research Disclosure*, Vol. 123, July 1974, Item No. 12331, entitled *Neutralizing Materials in Photographic Elements*. Specific polymeric materials which have been demonstrated to be effective as barrier layers between dye image forming units have been disclosed in U.S. Pat. Nos. 3,384,483, 3,345,163, and 3,625,685.

The use of barrier layers during development in image diffusion transfer elements, particularly integral elements, to prevent diffusion of materials to the image receiving layer has been described by Buckler et al. in U.S. Pat. No. 3,679,409. Such barrier layers allow diffusion of image forming materials or products of such materials at high pH, such as the pH of the processing composition, prevent diffusion of such materials at low pH, and thereby prevent diffusion of the image forming materials after processing. Other means for forming barrier layers are disclosed in U.S. Pat. Nos. 3,576,626 and 3,597,197.

Hannie, in U.S. Pat. No. 4,056,394, discloses a timing layer which serves as a temporary barrier to penetration of alkaline processing solution. Said timing layer comprises 5 to 35 weight percent of polymerized ethylenically unsaturated monomer, 2 to 10 percent by weight of polymerized ethylenically unsaturated carboxylic acid, and 55 to 85 percent by weight of polymerized vinylidene chloride.

Brust et al., in U.S. Pat. No. 4,088,499, disclose a selectively permeable layer for diffusion transfer film units that is pH selectively permeable and comprises 0 to 100 mole percent of a polymerized monomer containing at least one active methylene group, from 0 to 90 mole percent of at least one additional hydrophilic polymerized ethylenically unsaturated monomer, and 0 to 80 mole percent of at least one additional hydrophobic polymerized ethylenically unsaturated monomer.

Abel, in U.S. Pat. Nos. 4,229,516 and 4,317,892, discloses a temporary barrier layer for use in color image transfer film units comprising a mixture of (1) 5 to 95 percent by weight of a copolymer comprising 55 to 85 percent by weight of vinylidene chloride, 5 to 35 percent by weight of an ethylenically unsaturated monomer, and 0 to 20 percent by weight of an ethylenically unsaturated carboxylic acid, and (2) from 5 to 95 percent by weight of a polymeric carboxy-ester-lactone. Mizukura and Koyama disclose, in U.S. Pat. No. 4,407,938, the use of a lactone polymer and a vinylidene chloride terpolymer in formulating temporary barrier layers.

Helling et al., in European Patent Document No. 48,412, disclose the formulation of temporary barrier layers of reduced permeability for alkali using copolymers of acid containing, acid free, and cross-linking monomers.

Abel and Bowman, in U.S. Pat. No. 4,504,569, disclose a temporary barrier layer comprising N-alkyl substituted acrylamide and a polymerized crosslinking monomer wherein the polymer has a solubility parameter from 13 to 16 at 25° C. The barrier layer is useful as a process timing layer in color image transfer film units.

Hayashi et al., in U.S. Pat. No. 4,614,681, disclose the use of a copolymer, having ethylene and vinyl alcohol repeating units, as a barrier layer to oxygen diffusion.

Bowman and Verhow, in U.S. Pat. No. 4,865,946, disclose a temporary barrier layer comprising polymerizable monomers of certain acrylamides, crosslinking groups, and other ethylenically unsaturated monomers. Said barrier layers are useful in color image transfer units.

Holmes and Campbell, in U.S. Pat. No. 4,055,429, disclose a polymeric barrier layer for scavanging diffusible dyes.

Problems with Prior Art

Photographic elements containing image transfer diffusible dyes, when processed in developer baths of the type normally encountered in the photofinishing trade, suffer from a high degree of dye washout. This washout represents a major inefficiency in dye utilization, since the dye which washes out into the developer solution or other processing solution is no longer available to provide a dye image in the photographic element. Furthermore, this washout results in severe seasoning of the developer baths and in the unwanted accumulation of precipitates in low pH stop and bleaching baths.

These and other problems may be overcome by the practice of our invention.

SUMMARY OF THE INVENTION

It is an object of our invention to overcome disadvantages of the prior processes and apparatus.

An object of the present invention is to provide a chromogenic photographic material with a high density and low fog image. A further object of the present invention is to provide improved image dye retention in the photographic element. Yet another object of the present invention is to minimize the seasoning of processing solutions with diffusible dyes.

In accordance with this invention a conventional photographic element for processing in moderate to large volume photofinishing baths is provided wherein said element comprises one and only one dimensionally stable layer comprising a coating support, and coated thereon in reactive association an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound.

MODES FOR CARRYING OUT THE INVENTION

Figure 1:
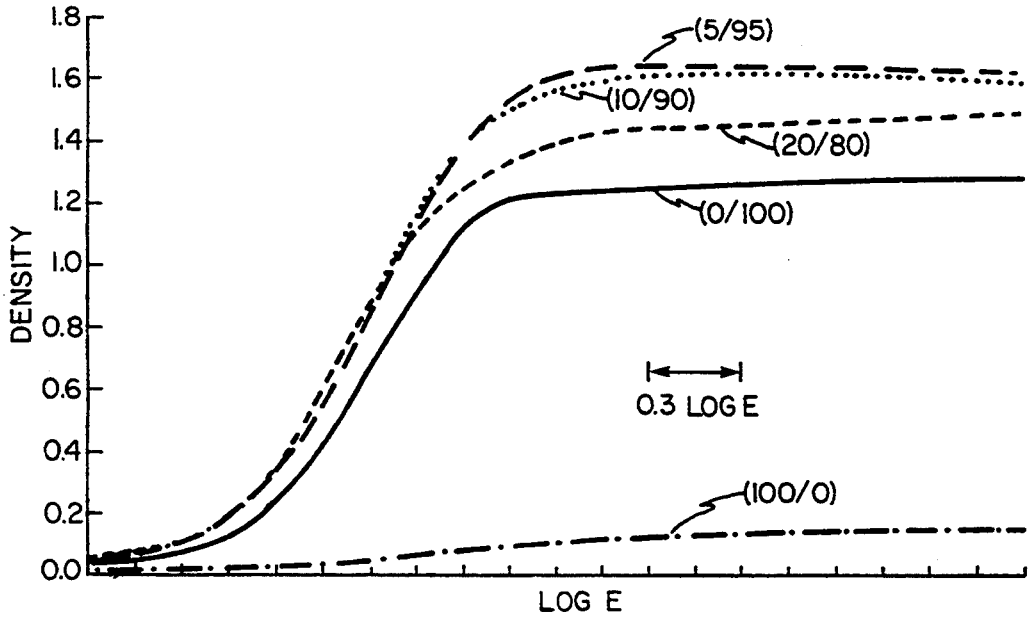
FIG. 1. Sensitometry obtained for coatings of coupler M processed as described in Examples 1–5. The gelatin/barrier polymer weight ratios coated in the respective barrier layers are indicated for each curve.

The term "nondiffusing" used herein as applied to the couplers and diffusible dye forming compounds has the meaning commonly applied to the term in color photography and denotes materials which for all practical purposes do not migrate or wander through organic colloid layers, such as gelatin, comprising the sensitive elements of the invention. The term "diffusible" as applied to dyes formed from these "nondiffusing" couplers and compounds in the processes has the converse meaning and denotes materials having the property of diffusing effectively through the colloid layers of the sensitive elements in the presence of the "nondiffusing" materials from which they are derived.

Preferred diffusible dye forming compounds are of various types. Particularly preferred are compounds of the type

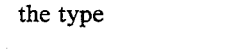

Dye-Y-Cp-D-B (I)

where D is a photographically inert linkage joining a ballast group B to a coupler residue Cp in a noncoupling position and Y is a splittable linkage, such as an azo group, attaching the diffusible dye moiety (Dye) to the coupler residue in the coupling position. Such compounds are nondiffusing couplers having a removable solubilized preformed azo or other dye-forming moiety in the coupling position through a linkage which is split during development leading to the formation of a dye diffusible in layers wetted with processing solutions, and, when necessary because of the diffusible nature of the molecule, a ballast group in a noncoupling position rendering the compound nondiffusing.

Preferred also are compounds of the type

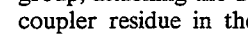

$B\text{-}Y\text{-}(Cp\text{-}D\text{-}R)_n$ (II)

where D is a photographically inert linkage joining the solubilizing group R to the coupler moiety Cp in a noncoupling position, and Y is a splittable linkage joining the ballast group B to the coupler residue in the coupling position, and n is 1 or 2. These nondiffusing couplers have a removable ballast group that renders the coupler nondiffusing until the ballast is split off during development and a solubilizing group in a noncoupling position that imparts diffusibility to the dye obtained in photographic processing solutions such as alkaline developing solutions.

Preferred photographically inert linkages, D, include —N=N—, —O—, —Hg—, >CH—, =CH—, —S—, and —S—S—. Other preferred inert linkages include those disclosed in British Patent Specification No. 904,364 on page 4 in lines 6 through 12.

The acidic solubilizing radicals attached to the diffusible dye forming compounds described above can be solubilizing radicals which when attached to the coupler or developer moieties of the dyes, render the dyes diffusible in alkaline processing solutions. Preferred solubilizing groups which render the dyes diffusible in alkaline processing solutions include $—SO_3H$, $—CH_2OH$, $—C_2H_4OH$, $—CH(OH)CH_2OH$, $—PO_3H_2$, $—AsO_3H_2$, —COOH, and $—SO_2NH_2$.

Preferred dye radical substituents include azo, azomethine, indoaniline, indophenol, anthraquinone, and related dye radicals well known in the art that exhibit selective absorption in the visible spectrum. The dye radicals contain acidic solubilizing moieties.

The nature of the ballast groups in the coupler compounds is not especially critical as long as the groups confer nondiffusibility to the coupler compounds and do not have a character such that the diffusible dyes are prevented from being formed through reaction with the developer. Typical ballast groups exemplified hereinafter in the specific couplers disclosed include long chain alkyl radicals linked directly or indirectly to the coupler molecules by a splittable linkage or by a removable or irremovable but otherwise nonfunctional linkage depending upon the nature of the coupler compound. Preferred ballast groups have eight or more carbon atoms.

The coupler residues in the above structures I and II are well known in the photographic art, as are the corresponding coupling positions. 5-Pyrazolone coupler radicals couple at the carbon atom in the 4-position; phenolic coupler radicals, including α-naphthols, couple at the carbon atom in the 4-position; open chain ketomethylene coupler radicals couple to the carbon atom forming the methylene moiety, for example, the C atom in the $—CO—CH_2—CO—$ group. Preferred examples of diffusible dye forming compounds are disclosed in British Patent Specification No. 904,364 on pages 6 through 14 as compound I through XXX and are incorporated herein by reference. Preferred examples of diffusible dye forming compounds are disclosed in U.S. Pat. No. 3,227,550 in columns 4 through 17 as compound I through LV and are incorporated herein by reference. Preferred examples of diffusible dye forming compounds designated as couplers Y-1 through Y-15, M-1 through M-15, and C-1 through C-19 are disclosed in European Patent Specification No. 115,303 B 1 of Arakawa and Watanabe on pages 9–23 of the published specification and in German Often. No. 3,324,533 A1 of Sakanoue et al. on pages 20–41 and are incorporated herein by reference. Preferred examples of diffusible dye releasing couplers are disclosed in U.S. Pat. No. 4,141,730 of Mimagawa et al. as Compounds 1–35 in columns 5–20 of the specification and are incorporated herein by reference.

Other preferred diffusible dye forming compounds are of the type

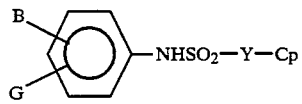

(III)

wherein Cp is a photographic coupler moiety capable of reacting with oxidized aromatic primary amino color developing agent to produce diffusible dye or diffusible dye radical or diffusible dye precursor, B— is a ballast radical as described above, and —G is —OR or $—NR_1R_2$ wherein R is hydrogen or a hydrolyzable moiety and $R_1$ and $R_2$ are each hydrogen or an alkyl group, and —Y— is a divalent linking group. It is particularly preferred in the compounds of structure III that $R_1$ and $R_2$ are alkyl groups having 8 to 22 carbon atoms. Preferred examples of diffusible dye forming compounds according to structure III are disclosed by Figueras and Stem in U.S. Pat. No. 3,734,726 (May 22, 1973) in column 5 and designated as compounds 1 through 6 and are incorporated herein by reference. Other preferred examples of diffusible dye forming compounds according to structure III are disclosed by Fleckenstein and Figueras in German Patent No. 2,242,762 (May 22, 1973) on pages 21–49 and designated as compounds I through XLV.

Further preferred are diffusible dye forming compounds of the type

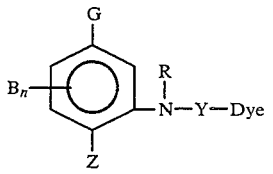

(IV)

wherein $B_n$ is one or more photographically inert organic ballasting radicals of such molecular size and configuration as to render said molecule nondiffusible during development in alkaline color developing solution; G is an —OR′ or —$NR_1R_2$ radical wherein R′ is hydrogen or a hydrolyzable moiety and $R_1$ and $R_2$ are each hydrogen or an alkyl group; Z is hydrogen or is selected from the group consisting of radicals replaceable by oxidized aromatic amino color developer; R is hydrogen, alkyl, or substituted alkyl; Y is a divalent linking radical selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula IV have been disclosed in columns 5–7 of U.S. Pat. No, 3,443,939 (May 13, 1969) of Bloom and Rogers and designated as compounds 1–8, and are incorporated herein by reference. Additionally preferred are diffusible dye forming compounds of the type

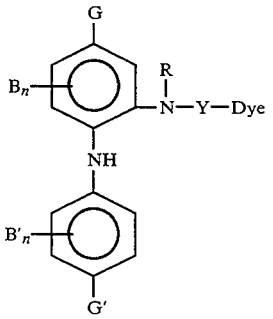

(V)

wherein $B_n$ and $B'_n$ each represent a photographically inert organic ballasting radicals of such molecular size and configuration as to render said molecule nondiffusible during development in alkaline color developing solution; G and G′ each is hydrogen, hydroxy, —OR′, or —$NR_1R_2$ radical wherein R′ is a hydrolyzable moiety and $R_1$ and $R_2$ are each hydrogen or an alkyl group provided at least one of G and G′ is hydroxy or amino; R is hydrogen, alkyl, or substituted alkyl; Y is a divalent linking radical selected from the group consisting of an azo radical, a mercuri radical, an oxy radical, an alkylidene radical, a thio radical, a dithio radical, and an azoxy radical; Dye is a dye radical or dye precursor. Preferred examples of compounds according to formula V have been disclosed in columns 7–13 of U.S. Pat. No. 3,443,939 (May 13, 1969) of Bloom and Rogers and designated as compound 1–23 and U.S. Pat. No. 3,498,785 (Mar. 3, 1970) of Bloom and Stephens and designated as compounds 1–22, and in columns 9–13 of U.S. Pat. No. 3,751,406 (Aug. 7, 1973) of Bloom as compounds designated 9–31, and are incorporated herein by reference.

Couplers according to formulae I, II, and III may be synthesized by methods well known in the an. In particular, diffusible dye-forming compounds according to structures I and II may be synthesized according to methods detailed in British Patent Specifications 840,731 (Jul. 6, 1960) and 904,364 (Aug.29, 1962) of Whitmore and Mader, in U.S. Pat. No. 3,227,550 (Jan. 4, 1966) of Whitmore and Mader, in U.S. Pat. No. 4,141,730 (Feb.27, 1979) of Minigawa.,in U.S. Pat. No. 4,420,556 (Dec. 13, 1983) of Booms and Holstead, in German Offen. No. 3,324,533 A1 (Jan. 12, 1984) of Sakanoue et al., and in European Patent Specification No. 115,303 B 1 (Oct. 4, 1989) of Arakawa and Watanabe, the disclosures of which are incorporated herein by reference. Compounds of formulae I and II may be synthesized, for example, by using methods described in U.S. Pat. Nos. 3,227,554, 4,264,723, 4,301,235, and 4,310,619 and in Japanese Patent Applications (OPI) 1938/81, 3934/82, 4044/82, 105226/78, 122935/75, and 126833/81. Compounds according to formula III and IV may be synthesized by methods described in U.S. Pat. Nos. 3,734,726 (May 22, 1973) of Figueras and Stern, 3,928,312 (Dec. 23, 1975) of Fleckenstein, and 4,076,529 (Feb. 28, 1978) of Fleckenstein and Figueras, and in German Patent No. 2,242,762 (Mar. 8, 1973) of Fleckenstein and Figueras. Compounds according to formulae IV and V may be synthesized by methods described or referenced in U.S. Pat. Nos. 3,443,939 (May 13, 1969) and 3,498,785 (Mar. 3, 1970) of Bloom and Stephens and 3,751,406 (Aug. 7, 1973) of Bloom.

Color developing agents which are useful with the nondiffusing couplers and compounds of this invention include the following:

4-amino-N-ethyl-3-methyl-N-(β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4- amino-N-methyl-N-(β-carboxyethyl)aniline
4-amino-N,N-bis-(β-hydroxyethyl)aniline
4-amino-N,N-b is-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline The polymers of this invention can be used as barrier layers to diffusible dyes and their precursors. The polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the polymers of this invention do not contain groups which significantly absorb, scavenge, or mordant diffusible dyes, for example, secondary, tertiary, or quaternary ammonium groups. The polymer should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The preferred polymers are cationic. The molecular weight of the polymers must be such that they are practical to coat, and is preferably 50,000 to 1,000,000.

The polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers, particularly acrylate, methacrylate, acrylamide and methacrylamide monomers which includes analogs of said monomers.

The more preferred polymers contain repeating units of the formula -(A)-(B)- wherein A is a hydrophobic ethylenically unsaturated monomer and B is an ionic hydrophilic ethylenically unsaturated monomer. A may be selected from, for example, vinyl ketones, alkylvinyl esters and ethers, styrene, alkylstyrenes, halostyrenes, acrylonitrile, butadiene, isoprene, chloroprene, ethylene and alkylsubstituted ethylenes, haloethylenes, and vinylidene halides. Examples of hydrophobic monomers are listed in *Research Disclosure* No. 19551, p. 301, July, 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anhydride, maleimides, vinylimides, vinylhalides, vinyl aldehydes, substituted styrenes, and vinyl heterocycles. Other examples of ionic monomers are listed in *Research Disclosure* No. 19551, p. 303, July 1980 hereby incorporated by reference. The more preferred monomers of group A and B are acrylamides, methacrylamides, acrylates, and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly useful are polymers containing repeating units derived from ethylenically unsaturated monomers of the formula $-(A)_m-(B)_n-$.

A is a hydrophobic monomer yielding the repeating unit

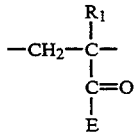

where $R_1$ is hydrogen or methyl; E is $—OR_2$ or $—NR_3R_4$; $R_2$ is a substituted or unsubstituted straight, branched, or cyclic alkyl or aryl group of about 1 to 10 carbon atoms; $R_3$ and $R_4$ are independently selected from hydrogen or any $R_2$ group and $R_3$ and $R_4$ together contain at least 3 carbon atoms; and m is 0 to 99.5 mole percent. B is an ionic hydrophilic monomer yielding the repeating unit

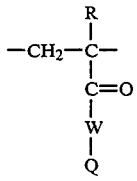

wherein R is hydrogen or methyl; W is $—OR_5$ or $—NR_6R_7$; $R_5$ is a straight, branched, or cyclic alkylene or arylene group of 1 to about 10 carbon atoms; $R_6$ is hydrogen or a straight, branched, or cyclic alkyl or aryl group from 1 to about 6 carbon atoms; $R_7$ is a straight, branched or cyclic alkylene or arylene group of 1 to about 10 carbon atoms, n is 0.5 to 100 mole percent; and Q is an ionic functional group independently selected from:

(a) $—NH_2$ or the acid addition salt $—NH_2$:HX, where X is an appropriate acid anion or (b) $—CO_2M$, $—SO_3M$, $—OSO_3M$, $—OP)_3M$, and —OM where M is an appropriate cation.

When the polymers of this invention are derived from monomers A and B of the above formula and both A and B are acrylamide or methacrylamide monomers monosubstituted on the amide nitrogen the polymers fall within a class of polymers known as Thermo Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein.

$R_2$, $R_3$, and $R_4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitfile groups. The monomers of group A may also contain reactive functional groups so that the polymers may perform other photographically useful functions common to interlayers between imaging layers and protective layers over imaging layers. $R_2$, $R_3$, $R_4$, $R_5$, $R_6$ and $R_7$ may be substituted with groups that can form heterocyclic rings. The straight, branched or cyclic alkyl groups of A and B include all isomeric forms and may contain one or more sites of unsaturation. In an embodiment of the present invention, $R_2$ is a substituted or unsubstituted straight, branched, or cyclic alkyl or aryl group of 1 to 10 carbon. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole percent and n is about 0.5 to 100 mole percent. When the polymer is a TRG polymer m is preferably about 40 to 99 mole percent and n is preferably about 1 to about 60 mole percent.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^{2-}$, $HCO_3^-$, and $CO_3^{2-}$ with $Cl^-$being most preferred. Appropriate cations include, but are not limited to, $H^+$, alkali metal, and ammonium, with $Na^+$ and $H^+$ being most preferred.

Examples of preferred monomers from group A are N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate, and benzylmethacrylate. Examples of preferred monomers from group B are N-(3-aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

The polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary, or quaternary ammonium groups. Preferred monomers are ethylenically unsaturated monomers, for example, N-vinyl pyrrolidone, N-vinyl-e-caprolactam, vinyloxazolidone, vinyl menthyloxazolidone, maleimide, N-methylolmaleimide, maleic anhydride, N-vinylsuccinamide, acryloylurea, cyanomethylacrylate, 2-cyanoethyl acrylate, glycerylacrylate, acryloyloxypolyglycerol, allyl alcohol, vinyl benzyl alcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl-2-acrylamide-2-methoxy acetate, N-hydroxypropylacrylamide, ethylacrylamidoacetate, N-acetamidoacrylamide, N-(m-hydroxyphenyl)-acrylamide, 2-acrylamide-2-hydroxymethyl-1,3-propane diol, and N-(3- or 5-hydroxymethyl-2-methyl-4-oxo-2-pentyl)acrylamide. Other suitable hydrophilic monomers are listed in *Research Disclosure* No. 19551, p.305, July 1980 hereby incorporated by reference. Examples of preferred hydrophilic nonionic monomers are acrylamide, methacrylamide, N,N-dimethylacrylamide, hydroxyethylacrylamide, hydroxyethyl acrylate, hydroxyethylmethacrylate, hydroxypropyl acrylate, hydroxypropylmethacrylate, and methylene-bis-acrylamide. The hydrophilic nonionic monomer may be 0 to about 70 mole percent and preferably about 10 to 65 mole percent. The polymer layers must also have enough physical integrity to survive processing intact. Those skilled in the art will recognize that many of the monomers discussed above contain structural elements that will meet this parameter. For example polymers containing the cationic hydrophilic monomer N-(3-aminopropyl)methacrylamide hydrochloride also crosslink in the presence of many gelatin hardeners. Polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates, and carbodimides. Preferred are monomers containing active methylene groups such as 2-acetoacetoxyethylmethacrylate, ethylmethacryloylacetoacetate, and N-2-acetoacetoxyethylacrylamide. Alternatively, di- or multi-functional monomers such as methyleneobisacrylamide or ethylene glycol-dimethacrylate may be used, whereby polymers are prepared as crosslinked colloidal particles that are swellable and dispersible in water. Polymer examples of this invention are comprised of monomers whose structures are shown below in Table 1, and are listed in Table 2 which provides the monomer feed ratios used, charge type, and also indicates which of the polymers are of the preferred TRG class.

TABLE 1

| Monomers $CH_2{=}C(XX)(YY)$ |
|---|
| Hydrophobic Monomers |
| IPA (N-isopropylacrylamide) |
| XX = —H |
| YY = —(CO)—(NH)—$CH(CH_3)_2$ |
| TBA (N-t-butylacrylamide) |
| XX = —H |
| YY = —(CO)—(NH)—$C(CH_3)_3$ |
| NBA (N-butylacrylamide) |
| XX = —H |
| YY = —(CO)—(NH)—$C_4H_9$ |
| TBMA (N-t-butylmethacrylamide) |
| XX = —$CH_3$ |
| YY = —(CO)—(NH)—$C(CH_3)_3$ |
| DOA (N-(1,1-dimethyl-3-oxobutyl)-acrylamide) |
| XX = —H |
| YY = —(CO)—(NH)—$C(CH_3)_2$—$CH_2$—(CO)—$CH_3$ |
| NBM (N-butylmethacrylate) |
| XX = —$CH_3$ |
| YY = —(CO)—O—$C_4H_9$ |
| 2EHM (2-ethyl-hexylmethacrylate) |
| XX = —$CH_3$ |
| YY = —(CO)—O—$CH_2CH(C_2H_5)CH_2CH_2CH_2CH_3$ |
| BZM (benzylmethacrylate) |
| XX = —$CH_3$ |
| YY = —(CO)—O—$CH_2$—phenyl |
| AAM (2-acetoacetoxyethylmethacrylate; a crosslinker) |
| XX = —$CH_3$ |
| YY = —(CO)—O—$CH_2CH_2$—O—(CO)—$CH_2$—(CO)—$C_4H_9$-n |
| Neutral Hydrophilic Monomers |
| A (acrylamide) |
| XX = —H |
| YY = —(CO)—$NH_2$ |
| HEM (hydroxyethylmethacrylate) |
| XX = —$CH_3$ |
| YY = —(CO)—O—$CH_2CH_2OH$ |
| MBA (methylene-bis-acrylamide; difunctional) |
| $CH_2$=CH—(CO)—(NH)—$CH_2$—(NH)—(CO)—CH=$CH_2$ |
| Cationic Hydrophilic Monomers |
| APM (N-(3-aminopropyl)methacrylamide hydrochloride) |
| XX = —$CH_3$ |
| YY = —(CO)—(NH)—$CH_2CH_2CH_2NH_3^+Cl^-$ |
| AEM (aminoethylmethacrylate hydrochloride) |
| XX = —$CH_3$ |
| YY = —(CO)—O—$CH_2CH_2NH_3^+Cl^-$ |
| Anionic Hydrophilic Monomers |
| SEM (sulfoethylmethacrylate sodium salt) |
| XX = —$CH_3$ |
| YY = —(CO)—O—$CH_2CH_2SO_3^-Na^+$ |
| SSA (N-(2-sulfo-1,1-dimethylethyl)acrylamide sodium salt) |
| XX = —$CH_3$ |
| YY = —(CO)—(NH)—$C(CH_3)_2CH_2SO_3^-Na^+$ |
| CEA (N-2-carboxyethylacrylamide) |
| XX = —H |
| YY = —(CO)—(NH)—$CH_2CH_2CO_2H$ |

TABLE 2

| Monomer Composition of Polymers | | | | | |
|---|---|---|---|---|---|
| Label | Type | Monomers | Monomer Ratio | TRG? | Ratio % |
| D | + | (IPA)(APM) | 90:10 | Yes | Mole |
| E | + | (IPA)(APM) | 92:8 | Yes | Mole |
| F | + | (IPA)(A)(APM) | 85:10:5 | Yes | Mole |
| G | + | (TBA)(APM) | 75:25 | Yes | Mole |
| H | + | (TBA)(APM) | 80:20 | Yes | Mole |
| I | + | (TBA)(APM) | 83:17 | Yes | Mole |
| J | + | (TBA)(APM) | 84:16 | Yes | Mole |
| K | + | (NBA)(APM) | 80:20 | Yes | Mole |
| L | + | (TBMA)(APM) | 80:20 | Yes | Mole |
| M | + | (TBA)(IPA)(APM) | 65:20:15 | Yes | Mole |
| N | + | (DOA)(APM) | 80:20 | Yes | Mole |
| O | + | (TBA)(DOA)(APM) | 60:20:20 | Yes | Mole |
| P | + | (IPA)(MBA)(APM) | 80:10:10 | Yes | Weight |
| Q | + | (NBM)(AEM)(HEM) | 50:15:35 | No | Weight |
| Qa | + | (NBM)(AEM)(HEM) | 50:30:20 | No | Weight |
| R | + | (NBM)(AEM)(HEM) | 40:25:35 | No | Weight |
| S | + | (NBM)(AEM)(HEM) | 26:22:52 | No | Weight |
| T | + | (NBM)(AEM)(HEM) | 20:15:65 | No | Weight |
| U | − | (TBA)(A)(SSA) | 75:20:5 | Yes | Mole |
| V | − | (NBM)(SEM)(AAM)(HEM) | 60:5:10:25 | No | Weight |
| Va | − | (NBM)(SEM)(AAM)(HEM) | 70:2.5:10:17.5 | No | Weight |
| Vb | − | (BZM)(SEM)(AAM)(HEM) | 50:2.5:10:37.5 | No | Weight |
| Vc | − | (2EHM)(SEM)(AAM)(HEM) | 50:5:10:35 | No | Weight |
| Vd | − | (NEM)(SEM)(AAM)(HEM) | 50:5:10:35 | No | Weight |
| Ve | − | (BZM)(SEM)(AAM)(HEM) | 60:2.5:10:27.5 | No | Weight |
| W | +/− | (TBA)(CEA)(APM) | 76:8:16 | Yes | Mole |
| X | +/− | (TBA)(A)(IPA)(APM) | 76:8:16 | Yes | Mole |
| Y | +/− | (TBA)(A)(SSA)(APM) | 65:20:5:10 | Yes | Mole |

The polymers can be prepared by synthetic procedures well known in the art. The polymers of this invention may be coated in the conventional manner. The amount of permeability of the barrier layer may be adjusted by adding gelatin or other water soluble polymers to the layer. Such water soluble polymers may comprise up to 50 percent of the barrier layer, but preferably no more than 25 percent. This method of adjusting permeability is particularly useful with polymers containing a high proportion of hydrophobic monomers and can alleviate the need to prepare different polymers of varying desired levels of permeability. The permeability of the layer may also be adjusted by varying the thickness of the polymer or polymer/gelatin layer. It has also been noted that surfactants or surfactant-like compounds, used with the polymer may affect the permeability. The suffactants or suffactant-like compounds, for example 2,5-dihydroxy-4-(1-methylheptadecyl) benzenesulfonic acid-monapotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability. The TRG polymers described above are a particularly preferred class of polymers of this invention. Solutions of such polymers are advantageous for coating because they can either be heat thickened or chill thickened upon application to a film to form layers with sharp and distinct interfaces. The preparation of TRG polymers is more fully described in U.S. application Ser. No. 7/502,726, which is incorporated herein by reference.

The silver halide emulsion employed in the elements of this invention can be either negative working or positive working. Examples of suitable emulsions and their preparation are described in *Research Disclosure*, Sections I and II and the publication cited therein. Examples of suitable vehicles for the emulsion layers and other layers of elements of this invention are described in *Research Disclosure*, Section IX and the publications cited therein.

The photographic elements of this invention or individual layers thereof can contain, for example, brighteners (see *Research Disclosure*, Section V), antifoggants and stabilizers (see *Research Disclosure*, Section VI), antistain agents and image dye stabilizers (see *Research Disclosure*, Section VII, paragraphs I and J), light absorbing and scattering materials (see *Research Disclosure*, Section VIII), hardeners (see *Research Disclosure*, Section IX), plasticizers and lubricants (see *Research Disclosure*, Section XII) antistatic agents (see *Research Disclosure*, Section XIII), matting agents (see *Research Disclosure*, Section XVI), and development modifiers (see *Research Disclosure*, Section XXI).

The photographic elements can be coated on a variety of supports such as described in *Research Disclosure*, Section XVII and the references described therein. Photographic elements can be exposed to actinic radiation, typically in the visible region of the spectrum, to form a latent image as described in *Research Disclosure*, Section XVIII and then processed to form a visible dye image as described in *Research Disclosure*, Section XIX. Processing to form a visible dye image includes the step of contacting the element with a color developing agent to reduce developable silver halide and oxidizing the color developing agent. Oxidized color developing agent in turn reacts with the coupler to yield a diffusible dye.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image.

A preferred embodiment of the instant invention comprises a conventional color photographic element for processing in moderate to large volume photofinishing baths comprising one and only one dimensionally stable layer comprising a coating support, and coated thereon in reactive association an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound. Such an embodiment is suitably processed in a moderate to large volume corresponding to greater than 20 mL per square meter of element and preferably processed in a moderate to large volume corresponding to greater than 200 mL per square meter of element. A particular embodiment is coated so that the barrier layer is the most distal layer with respect to the support. Another embodiment comprises a layer coated on the side of the support opposite the imaging layer. In a further embodiment the barrier layer comprises an ultraviolet filter dye. Yet in another embodiment, the barrier layer comprises a polymer coated at a level of 100 mg/m$^2$ to 10 g/m$^2$, and in a more preferred embodiment the barrier layer comprises a polymer coated at a level of 750 mg/m$^2$ to 2 g/m$^2$.

Another preferred embodiment of the instant invention comprises a process for forming a conventional color photographic image comprising the steps of:

(a) using an integral element comprising one and only one dimensionally stable layer comprising a coating support, and coated thereon in reactive association an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, and wherein said barrier layer impedes the diffusion out of said element of the diffusible dye formed from said diffusible dye forming compound;

(b) exposing said element to actinic radiation (c) processing said element by contacting said element to an external bath containing compounds selected from the group consisting of conventional color developer compounds of the primary amine type, compounds which activate the release of incorporated color developers, and compounds which activate development by incorporated dye developers;

(d) washing said element to remove compounds imbibed in step (c).

The advantages of the present invention will become more apparent by reading the following examples. The scope of the present invention is by no means limited by these examples, however.

EXAMPLE 1-15

Preparation of Barrier Polymer

To a twelve-liter 3-necked flask, fitted with a stirrer and condenser, was added about 3500 g of methanol and about 1500 g of distilled water. The solution was degassed for about 30 minutes with nitrogen. About 1067.4 g of t-butyl acrylamide (TBA), about 285 g of N-(3-aminopropyl) methacrylamide hydrochloride (APM), and about 2.0 g of AIBN (2,2'-azobisisobutylnitrile) were then added and the solution was stirred at about 60° C. under nitrogen for about 16 hours. A clear, viscous solution was obtained. The condenser was removed and about 6 kg of distilled water was added. The solution was stirred at 80° C. with a strong nitrogen sweep for 16 hours to remove the methanol. The solution was cooled to give a gel containing about 13.2% solids with an IV of 1.02 in 0.1M LiCl/methanol. This copolymer of TBA and APM at mole ratio 84:16 (polymer J in Table 2) is designated "VMX" for reference purposes in the following.

Preparation of Coupler Dispersions

Dispersions of couplers M, Y, and C (Table 3) were prepared by colloid milling methods well known in the art. About 8.25 g of coupler M was dissolved in about 33 g of cyclohexanone. About 5 g of a 10% (w/w) Alkanol-XC TM (Du Pont) aqueous solution, about 88 g of 12.5% (w/w) aqueous gelatin, and about 149 g of water were combined at 50° C. These aqueous and cyclohexanone solutions were then combined and briefly mechanically stirred. The resulting mixture was then passed through a Gaulin colloid mill five times, and the dispersions was stored in the cold until used for coating. About 8.4 g of coupler Y was dissolved in about 16.8 g of ethylacetate. About 5 g of a 10% (w/w) Alkanol-XC TM aqueous solution, about 90 g of 12.5% (w/w) aqueous gelatin, and about 160 g of water were combined at 50° C. These aqueous and ethylacetate solutions were then combined and briefly mechanically stirred. The resulting mixture was then passed through a Gaulin colloid mill five times, and the dispersions was stored in the cold until used for coating. About 9.3 g of coupler C was dissolved in about 18.6 g of ethylacetate. About 5.4 g of a 10% (w/w) Alkanol-XC TM aqueous solution, about 99 g of 12.5% (w/w) aqueous gelatin, and about 198 g of water were combined at 50° C. These aqueous and ethylacetate solutions were then combined and briefly mechanically stirred. The resulting mixture was then passed through a Gaulin colloid mill five times, and the dispersions was stored in the cold until used for coating.

Coating of Photographic Elements

All coatings were made on film support (7 mil polyterephthalate base) and consisted of a two-layer structure. The layer coated immediately upon the support comprised a blue sensitized silver chloride emulsion, coupler, and gelatin as binder. The silver chloride emulsion was coated at a coverage of 430 mg/m$^2$ as silver and gelatin was coated at a coverage of 1.61 g/m$^2$. In examples 1 to 5, coupler M was coated at a coverage of 540 mg/m$^2$. In examples 6 to 10, coupler Y was coated at a coverage of 560 mg/m$^2$. In examples 11 to 15, coupler C was coated at a coverage of 620 mg/m$^2$. The top layer in each of these coatings comprised a mixture of gelatin and the polymer VMX. The combined gelatin and VMX coverage in these overcoat layers was 1070 mg/m$^2$. The five coatings prepared with each coupler had variations in the gelatin to VMX weight ratio in these top layers. These weight ratios were 100/0 (examples 1, 6, and 11), 20/80 (examples 2, 7, and 12), 10/90 (examples 3, 8, and 13), 5/95 (examples 4, 9, and 14), and 0/100 (examples 5, 10, and 15) for gelatin to VMX, respectively. These two-layer coatings were hardened by the addition of 1,1'-bus[methylene bis(sulfonyl)]ethene at a level corresponding to 1.5% by weight of the total gelatin and VMX.

Processing and Sensitometry

These fifteen coatings were exposed for 0.01 s to a tungsten light source (2850° K.) through a 0–3 density 21-step tablet and processed at 95° F. The process comprised development for 45 s, 1 min (stop bath) in a 10% aqueous solution of acetic acid, 30 s wash in water, 90 s bleach-fix in KODAK EKTACOLOR RA Bleach-Fix solution, and 5 min wash in water, followed by drying. The developer solution was prepared according to the following composition:

| | |
|---|---|
| Triethanolamine | 12.41 g |
| Phorwite REU TM (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH = 10.04 @ 27° C. | |

Figure 2:
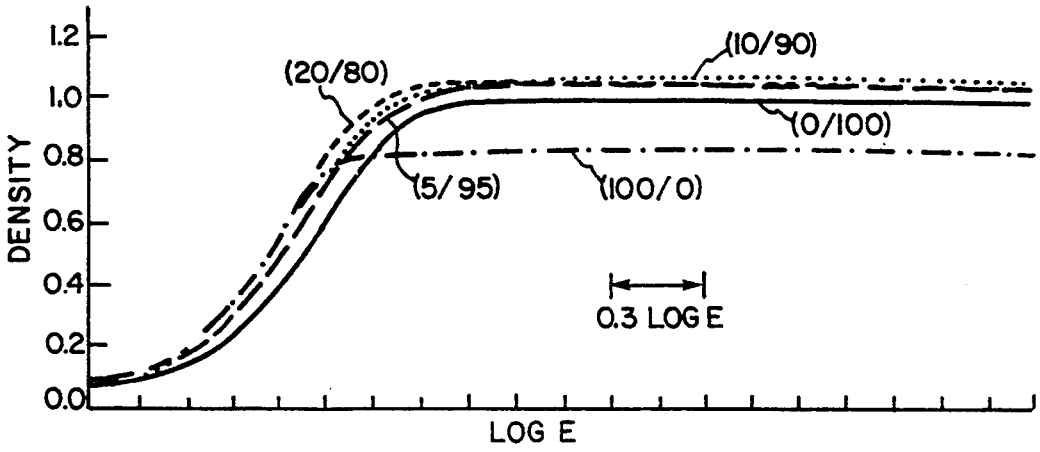
FIG. 2. Sensitometry obtained for coatings of coupler Y processed as described in Examples 6–10. The VMX/gelatin weight ratios coated in the respective barrier layers are indicated for each curve.
Figure 3:
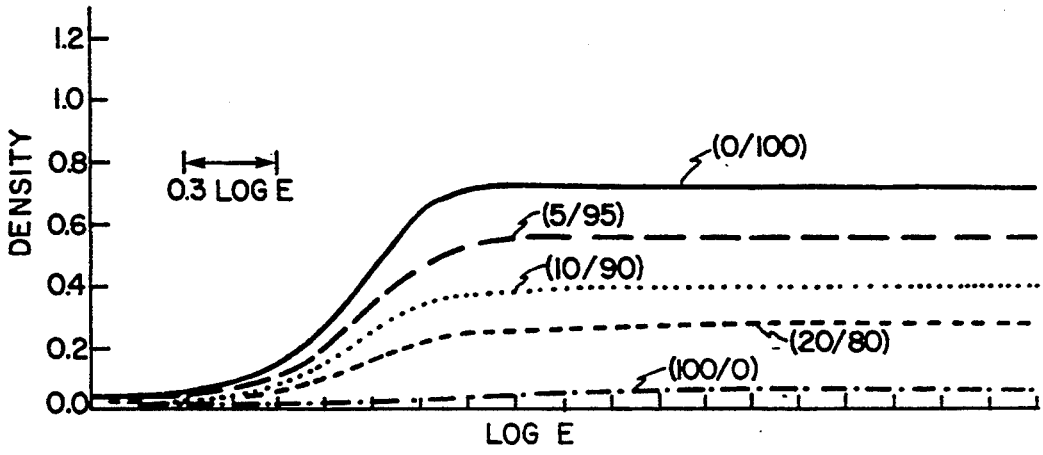
FIG. 3. Sensitometry obtained for coatings of coupler C processed as described in Examples 11–15. The VMX/gelatin weight ratios coated in the respective barrier layers are indicated for each curve.

The dye densities were then recorded using status-M filters. The corresponding sensitometry is illustrated in FIGS. 1, 2, and 3. The sensitometry for the dye produced in examples 1 to 5 for coupler M is illustrated in FIG. 1. There it can be seen that the control coating of example 1, that had no VMX (100/0) in the barrier layer, retained practically no dye (Dmax=0.16), since the dye that formed washed out into the developer processing solution. The other examples illustrated at barrier layer gelatin/VMX ratios of 20/80 (example 2), 10/90 (example 3), 5/95 (example 4), and 0/100 (example 5) retained large amounts of dye with Dmax ranging from 1.38 to 1.64. The sensitometry for the dye produced in examples 6 to 10 for coupler Y is illustrated in FIG. 2. There it can be seen that the control coating of example 6, that had no VMX (100/0) in the barrier layer, retained less dye than the other coatings retained. The other examples illustrated at barrier layer gelatin/VMX ratios of 20/80 (example 7), 10/90 (example 8), 5/95 (example 9), and 0/100 (example 10) retained 20% more dye than the control example 6, with Dmax of 1.0 to 1.08, compared to a Dmax of 0.83 in the control example 6. The sensitometry for the dye produced in examples 11 to 15 for coupler C is illustrated in FIG. 3. There it can be seen that the control coating of example 11, that had no VMX (100/0) in the barrier layer, retained practically no dye, since the dye that formed washed out into the developer processing solution. The other examples illustrated at barrier layer gelatin/VMX ratios of 20/80 (example 12), 10/90 (example 13), 5/95 (example 14), and 0/100 (example 15) retained significant amounts of dye with Dmax of 0.28 (20/80), 0.40 (10/90), 0.56 (5.95), and 0.72 (0/100). These examples clearly demonstrate that the use of barrier layers according to the present invention dramatically improves dye containment.

This invention has been described in detail with particular reference to preferred embodiments thereof, but it will be understood that variations and modifications can be effected within the spirit and scope of the invention.

TABLE 3

Coupler Structures

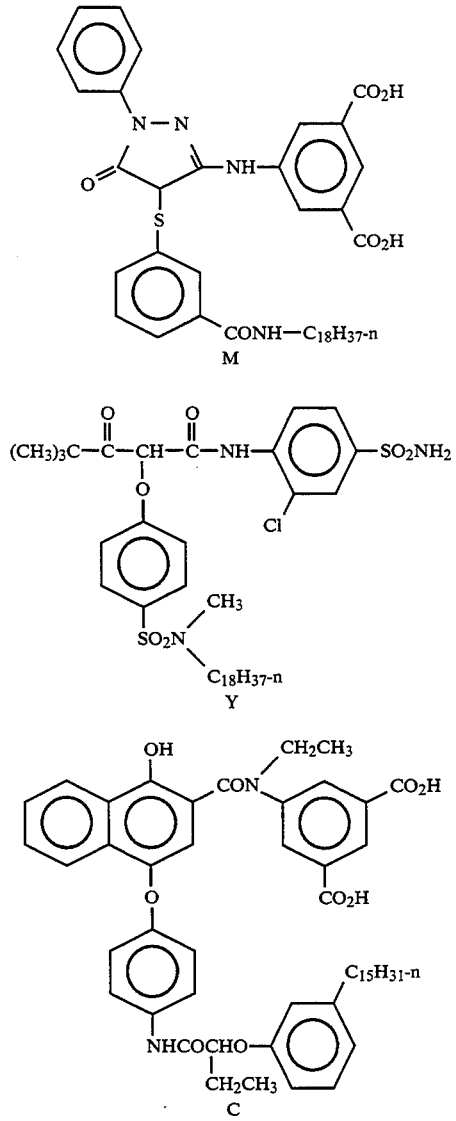

What is claimed is:

1. A process for forming a color photographic image comprising the steps of:

(a) providing an integral element comprising one and only one dimensionally stable layer comprising a coating support, and coated thereon in reactive association an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, wherein said barrier layer impedes the diffusion out of said element of the diffusible dye formed from said diffusible dye forming compound to an extent such that an increase in dye-density Dmax of at least 20% is obtained relative to a control barrier layer of gelatin of equivalent weight per unit area when said element after exposure to light is processed at 95° F. for at least 45 seconds in a pH 10 color developing bath and where said control barrier layer is devoid of said polymer, where the volume of said pH 10 color developing bath is greater than 200 mL per square meter of said element in contact with said bath, wherein said polymer contains from $1\times10^{-5}$ to $4\times10^{-3}$ moles of ion forming functional groups per gram of said polymer, wherein said polymer comprises repeating units derived from ethylenically unsaturated monomers, and wherein said monomers comprise monomers derived from hydrophobic acrylate, methacrylate, acrylamide, or methacrylamide monomers;

(b) exposing said element to actinic radiation (c) processing said element by contacting said element with an external bath containing compounds selected from the group consisting of color developer compounds, compounds which activate the release of color developers, and compounds which activate development by dye developers, wherein the volume of said external bath is greater than 200 mL per square meter of said element in contact with said external bath; and (d) washing said element to remove compounds imbibed in step (c).

2. A process as described in claim 1, wherein the barrier layer is the most distal layer with respect to said support.

3. A process as described in claim 1, wherein said barrier layer comprises an ultraviolet filter dye.

4. A process as described in claim 1, wherein said diffusible dye forming compound is a coupler molecule Dye—Y—Cp—D—B wherein:

Dye is a dye radical exhibiting selective absorption in the visible spectrum and contains an acidic solubilizing group;

Y is a linking radical selected from the group consisting of an azo radical, a mercuri radical, an oxy radical, a thio radical, a dithio radical, and an azoxy radical;

Cp is a coupler radical selected from the group consisting of a 5-pyrazolone coupler radical, a phenolic coupler radical, and an open chain ketomethylene coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

B is a photographically inert organic ballasting radical of such molecular size and configuration as to render said coupler molecule nondiffusible during development in an alkaline color developing solution.

5. A process as described in claim 1, wherein said diffusible dye forming compound is a coupler molecule $$B—Y—(Cp—D—R)_n$$

wherein:

B is a photographically inert organic ballasting radical of such molecular size and configuration as to render said coupler molecule nondiffusible during development in an alkaline color developing solution of color developing agent;

Y is a linking radical selected from the group consisting of an azo radical, a mercuri radical, an oxy radical, an alkylidene radical, a thio radical, a dithio radical, and an azoxy radical;

Cp is a coupler radical selected from the group consisting of a 5-pyrazolone coupler radical, a phenolic coupler radical, and an open chain ketomethylene coupler radical, said Cp being substituted in the coupling position with said Y linking group;

D is a linking radical selected from the group consisting of an azo radical, a mercuri radical, an oxy radical, an alkylidene radical, a thio radical, a dithio radical, and an azoxy radical;

R is selected from the group consisting of a hydrogen atom and an acidic solubilizing group when said color developing agent contains an acidic solubilizing group, and R is an acidic solubilizing group when said color developing agent is free of an acidic solubilizing group;

n is an integer of 1 to 2 when said linking radical Y is an alkylidene radical, and n is 1 when said linking radical Y is selected from the group consisting of an azo radical, mercuri radical, oxy radical, thio radical, dithio radical, and azoxy radical.

6. A process as described in claim 1, wherein said diffusible dye forming compound is a molecule

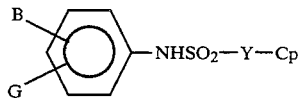

wherein:

B is a photographically inert organic ballasting radical of such molecular size and configuration as to render said coupler molecule nondiffusible during development in an alkaline color developing solution;

G is an —OR or —$NR_1R_2$ radical wherein R is hydrogen or a hydrolyzable moiety and $R_1$ and $R_2$ are each hydrogen or an alkyl group;

Y is a linking radical selected from the group consisting of an azo radical, a mercuri radical, an oxy radical, an alkylidene radical, a thio radical, a dithio radical, and an azoxy radical;

Cp is a coupler radical substituted in the coupling position with said Y linking group, a diffusible dye radical, or a diffusible dye precursor.

7. A process as described in claim 1, wherein said diffusible dye forming compound is a molecule

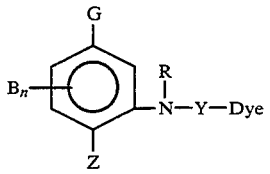

wherein:

$B_n$ is one or more photographically inert organic ballasting radicals of such molecular size and configuration as to render said molecule nondiffusible during development in an alkaline color developing solution;

G is an —OR′ or —$NR_1R_2$ radical wherein R′ is hydrogen or a hydrolyzable moiety and $R_1$ and $R_2$ are each hydrogen or an alkyl group;

Z is hydrogen or is selected from the group consisting of radicals replaceable by oxidized aromatic amino color developer;

R is hydrogen, alkyl, or substituted alkyl;

Y is a divalent linking radical selected from the group consisting of an azo radical, a mercuri radical, an oxy radical, an alkylidene radical, a thio radical, a dithio radical, and an azoxy radical;

Dye is a dye radical or dye precursor.

8. A process as described in claim 1, wherein said diffusible dye forming compound is a molecule

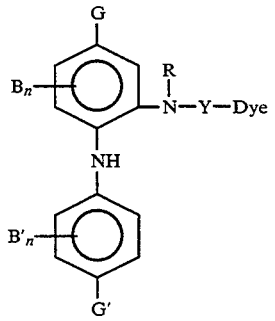

wherein:

$B_n$ and $B'_n$ each independently represent a photographically inert organic ballasting radical of such molecular size and configuration as to render said molecule nondiffusible during development in an alkaline color developing solution;

G and G′ each independently represent a hydrogen, hydroxy, —OR′, or —$N_1R_2$ radical wherein R′ is a hydrolyzable moiety and $R_1$ and $R_2$ are each hydrogen or an alkyl group provided at least one of G and G′ is hydroxy or said —$NR_1R_2$ radical;

R is hydrogen, or alkyl;

Y is a divalent linking radical selected from the group consisting of an azo radical, a mercuri radical, an oxy radical, an alkylidene radical, a thio radical, a dithio radical, and an azoxy radical;

Dye is a dye radical or dye precursor.

9. A process as described in claim 1, wherein said polymer is further comprised of repeating units derived from a nonionic hydrophilic ethylenically unsaturated monomer.

10. A process as described in claim 1, wherein said polymer comprises repeating units of the formula $$-(A)_m-(B)_n-$$

wherein

A is a hydrophobic monomer yielding the repeating unit

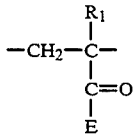

where $R_1$ is hydrogen or methyl;

E is —$OR_2$ or —$NR_3R_4$ $R_2$ is a substituted or unsubstituted straight, branched, or cyclic alkyl or aryl group of 1 to 10 carbon atoms wherein the substituents are selected from the group consisting of halide, alkoxy, acryloxy, styryl, sulfoxyalkyl, sulfoalkyl, nitro, thio, keto and nitrile;

$R_3$ and $R_4$ are independently selected from hydrogen or any $R_2$ group; and $R_3$ and $R_4$ together contain at least 3 carbon atoms;

m is 0 to 99.5 mole percent;

wherein

B is an ionic hydrophilic monomer yielding the repeating unit

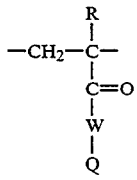

where

R is hydrogen or methyl;

W is —$OR_5$ or —$NR_6R_7$;

$R_5$ is a straight, branched, or cyclic alkylene or arylene group of 1 to 10 carbon atoms;

$R_6$ is hydrogen or a straight, branched, or cyclic alkyl or aryl group from 1 to 6 carbon atoms;

$R_7$ is a straight, branched or cyclic alkylene or arylene group of 1 to 10 carbon atoms;

n is 0.5 to 100 mole percent;

Q is an ionic functional group independently selected from:

(a) —$NH_2$ or the acid addition salt —$NH_2$:HX, where X is an acid anion or (b) —$CO_2M$, —$SO_2M$, —$OSO_3M$, —$OPO_3M$ and —OM where M is a cation.

11. A process as described in claim 1, wherein the barrier layer comprises a barrier polymer coated at a level of 100 mg/$m^2$ to 10 g/$m^2$.

12. A process as described in claim 1, wherein the barrier layer comprises a barrier polymer coated at a level of 750 mg/$m^2$ to 2 g/$m^2$.

13. A process as described in claim 1, wherein said integral element further comprises a layer coated on the side of the support opposite the imaging layer.

14. A process as described in claim 1, wherein said barrier layer comprises from $5\times10^{-5}$ to $2\times10^{-3}$ moles of ion forming functional groups per gram of barrier layer polymer.

15. A process as described in claim 1, wherein said polymer has a molecular weight of from 50,000 to 1,000,000.

16. A process as described in claim 10, wherein said hydrophobic monomer A is selected from the group consisting essentially of N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate, and benzylmethacrylate.

17. A process as described in claim 10, wherein said hydrophilic monomer B is selected from the group consisting essentially of N-(3-aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

18. A process as described in claim 10, wherein said polymer has from 10 to 65 mole percent hydrophilic monomer B.

19. A process for forming a color photographic image comprising the steps of:

(a) providing an integral element comprising one and only one dimensionally stable layer comprising a coating support, and coated thereon in reactive association an imaging layer comprising radiation sensitive silver halide, a diffusible dye forming layer comprising a diffusible dye forming compound, and a barrier layer overlaying said diffusible dye forming layer, wherein said support is selected from the group consisting of reflection base and transparent base materials, wherein said diffusible dye forming layer is the same or different than said imaging layer, wherein said barrier layer comprises a polymer that allows the passage of solutions for processing said element when said element is contacted with an external processing bath, wherein said barrier layer impedes the diffusion out of said element of the diffusible dye formed from said diffusible dye forming compound to an extent such that an increase in dye-density Dmax of at least 20% is obtained relative to a control barrier layer of gelatin of equivalent weight per unit area when said element after exposure to light is processed at 95° F. for at least 45 seconds in a pH 10 color developing bath and where said control barrier layer is devoid of said polymer, where the volume of said pH 10 color developing bath is greater than 200 mL per square meter of said element in contact with said bath, wherein said polymer contains from $1\times10^{-5}$ to $4\times10^{-3}$ moles of ion forming functional groups per gram, and wherein said polymer contains polymer selected from the group consisting essentially of water dispersible polyesters, polyamides, polyethers, polysulfones, polyurethanes, polyphosphazenes, proteins, polysaccharides, chitins, and mixtures thereof;

(b) exposing said element to actinic radiation (c) processing said element by contacting said element with an external bath containing compounds selected from the group consisting of color developer compounds, compounds which activate the release of color developers, and compounds which activate development by dye developers, wherein the volume of said external bath is greater than 200 mL per square meter of said element in contact with said external bath;

(d) washing said element to remove compounds imbibed in step (c).

20. A process as described in claim 19, wherein said barrier layer comprises from $5\times10^{-5}$ to $2\times10^{-3}$ moles of ion forming functional groups per gram of barrier layer polymer.

* * * * *